US006049692A

United States Patent [19]

Hwang

[11] Patent Number: 6,049,692

[45] Date of Patent: Apr. 11, 2000

[54] HEATING ROLLER APPARATUS FOR EQUIPMENT USING AN ELECTROPHOTOGRAPHIC PROCESS

[75] Inventor: Tae-Heum Hwang, Seoul, Rep. of Korea

[73] Assignee: SamSung Electronics Co., Ltd., Kyungki-do, Rep. of Korea

[21] Appl. No.: 08/617,353

[22] Filed: Mar. 18, 1996

[30] Foreign Application Priority Data

Jul. 4, 1995 [KR] Rep. of Korea ..... 95-19478

[51] Int. Cl.[7] ..... G03G 15/20

[52] U.S. Cl. ..... 399/333; 399/336

[58] Field of Search ..... 219/470, 471; 399/328, 330, 336, 333

[56] References Cited

U.S. PATENT DOCUMENTS

| | | | |
|---|---|---|---|
| 3,369,106 | 2/1968 | Troll | 219/471 |
| 4,389,452 | 6/1983 | Chahroudi et al. | 359/350 X |
| 4,540,267 | 9/1985 | Moser | 219/216 X |
| 4,763,158 | 8/1988 | Schlueter, Jr. | 219/216 X |
| 4,780,078 | 10/1988 | Masui | 399/330 X |
| 4,874,927 | 10/1989 | Shibata et al. | 399/330 X |
| 4,933,724 | 6/1990 | Sugimoto et al. | 219/216 X |
| 4,976,877 | 12/1990 | Agostinelli et al. | 219/216 |
| 5,115,279 | 5/1992 | Nishikawa et al. | 219/216 X |
| 5,180,899 | 1/1993 | Inasaki | 219/469 |
| 5,196,106 | 3/1993 | DuPree et al. | 205/67 |
| 5,270,777 | 12/1993 | Yoshida et al. | 219/216 X |
| 5,403,995 | 4/1995 | Kishino et al. | 219/216 |
| 5,485,359 | 1/1996 | Uehara et al. | 355/284 |
| 5,497,218 | 3/1996 | Amico | 399/328 X |

FOREIGN PATENT DOCUMENTS

| | | |
|---|---|---|
| 59-198118 | 11/1984 | Japan . |
| 62-123668 | 8/1987 | Japan . |
| 2-134671 | 5/1990 | Japan . |

*Primary Examiner*—Fred L Braun
*Attorney, Agent, or Firm*—Robert E. Bushnell, Esq.

[57] ABSTRACT

A fixing unit for an electrophotographic printing device includes a heating roller having an outermost surface for engaging a printable medium, and an innermost surface coated with an infrared radiation material for absorbing heat. A halogen lamp is axially installed along a central shaft within an interior of the heating roller for generating the heat absorbed by the infrared radiation material. A pressure roller is provided for engaging and applying pressure upon the printable medium as the printable medium passes between the heating roller and the pressure roller. The infrared radiation material is preferably formed with ceramics, and readily absorbs electromagnetic waves exhibiting wavelengths from 3 to 1000 microns.

9 Claims, 2 Drawing Sheets

HEATING ROLLER APPARATUS FOR EQUIPMENT USING AN ELECTROPHOTOGRAPHIC PROCESS

CROSS-REFERENCE TO RELATED APPLICATIONS

This application makes reference to, incorporates the same herein, and claims all benefits accruing under 35 U.S.C. § 119 arising from an application for Heating Roller Apparatus For Equipment Using An Electrophotographic Process earlier filed in the Korean Industrial Property Office on July 4, 1995 and there duly assigned Ser. No. 19478/1995.

BACKGROUND OF THE INVENTION

The present invention relates to an electrophotographic processor, such as a laser beam printer, a copier, a plain paper facsimile, etc., and more particularly, to a heating roller apparatus of a fixing unit for permanently fixing a toner image transferred onto a recording medium.

The electrophotographic printing process requires an image fixing procedure to fuse a toner image onto a receiving surface of a recording medium, such as paper, or the like. A typical image fixing unit comprises a heating roller and a pressure roller between which the recording medium passes. Various image fixing units for electrophotographic printing devices are disclosed in prior art; see, for example, U.S Pat. Nos. 4,933,724 and 5,115,279.

Several common problems exist with conventional image fixing units. One of these problems is the lack of temperature uniformity along the surface of the heating roller during the electrophotographic printing process. This problem, if severe enough, can result in the generation of printed copies which are defective. Another problem associated with conventional image fixing units is a prolonged delay time when warming up to perform an electrophotographic printing process. While this problem can be mitigated to a certain extent by simply maintaining the temperature of the heating roller at a predetermined temperature during non-printing periods, this solution has a disadvantage in that it consumes an unnecessary amount of electrical power.

SUMMARY OF THE INVENTION

Therefore, it is an object of the present invention to provide an improved heating roller is apparatus for equipment using an electrophotographic printing process.

It is another object to provide a heating roller apparatus which can provide a high degree of operating stability during an electrophotographic printing process.

It is still another object to provide a heating roller apparatus which provides uniform temperature distribution during an electrophotographic printing process.

It is yet another object to provide a heating roller apparatus which reduces the warm-up time for an electrophotographic printing process.

It is still yet another object to provide a heating roller apparatus which reduces power consumption during an electrophotographic printing process.

These and other objects can be achieved in accordance with the principles of the present invention with a fixing unit for an electrophotographic printing device. The fixing unit includes a heating roller having an outermost surface for engaging a printable medium, and an innermost surface coated with an infrared radiation material for absorbing heat.

A halogen lamp is axially installed along a central shaft within an interior of the heating roller for generating the heat absorbed by the infrared radiation material. A heat control unit, including a thermistor and a thermostat, are provided for controlling the heat generated by the halogen lamp. A pressure roller is provided for engaging and applying pressure upon the printable medium as the printable medium passes between the heating roller and the pressure roller. The infrared radiation material is preferably formed with ceramics, and readily absorbs electromagnetic waves exhibiting wavelengths from 3 to 1000 microns.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
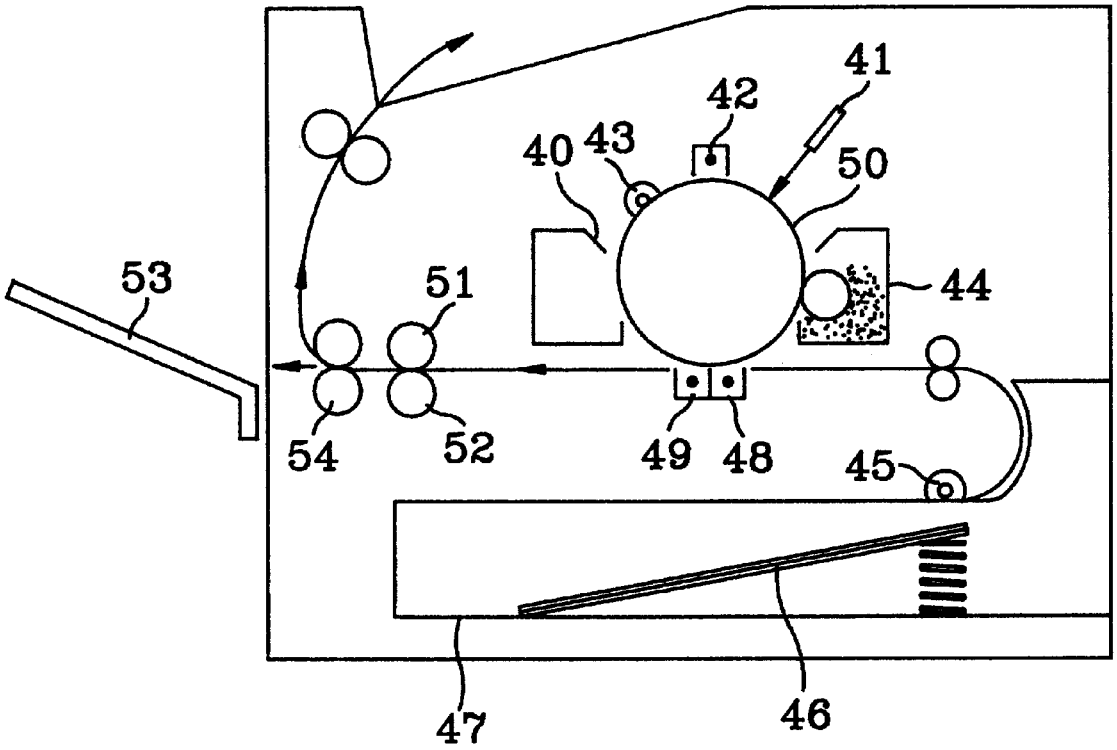
FIG. 1 is a schematic diagram providing an abstract representation of an electrophotographic printing device.

Turning now to the drawings and referring to FIG. 1, a schematic diagram providing an abstract representation of an electrophotographic printing device is shown. The electrophotographic printing device of FIG. 1 includes a photosensitive drum 50 which is uniformly charged on an outermost surface during rotation by the corona discharge of a charging unit 42. The charged portion of photosensitive drum 50 is exposed to light generated from a light emitting diode or a laser diode of an exposing unit 41. The light may, for example, be reflected from a document positioned on a document tray. A magnification/reduction ratio is processed by a mirror and a lens of exposing unit 41 so that an electrostatic latent image representative of the image of the document is formed on the outermost surface of photosensitive drum 50. While the outermost surface of photosensitive drum 50 passes by a developing unit 44, the electrostatic latent image is developed by toner to produce a visible toner image on the outermost surface of photosenstive drum 50. The visible image on the outermost surface of photosensitive drum 50 is then transferred onto a recording medium 46, such as paper, by the action of a transfer unit 48 after recording medium 46 is fed from a cassette 47 by a feeding roller 45.

Recording medium 46 adheres closely to the outermost surface of photosensitive drum 50 as a result of an electrostatic force, and a separating unit 49 separates recording medium 46 from the outermost surface of photosenstive drum 50. Recording medium 46 then passes between a heating roller 51 and a pressure roller 52 to enable fixation of the toner image onto recording medium 46. Recording medium 46 bearing the fixed image can then be expelled from the printing device into a tray 53 via delivery rollers 54.

After the electrophotographic printing process, toner that remains on the outermost surface of photosensitive drum 50 is eliminated by a cleaning unit 40, and the electrostatic latent image is eliminated by a latent image erasing lamp array 43.

Figure 2:
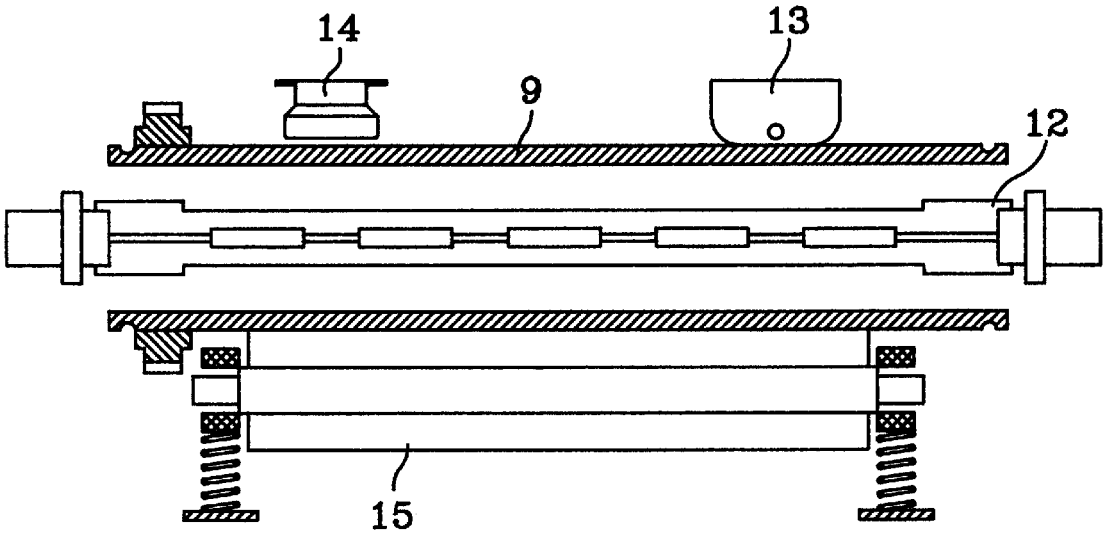
FIG. 2 is a schematic diagram providing an abstract representation of a fixing unit used in an electrophotographic printing device.

Referring to now FIG. 2, a schematic diagram providing an abstract representation of a fixing unit that can be used in the electrophotographic printing device of FIG. 1 is shown. The fixing unit of FIG. 2 includes a heating roller 9 and a pressure roller 15. Heating roller 9 can be constructed from an aluminum pipe, and is open on both ends. The innermost surface of heating roller 9 is coated with black paint to improve heat absorption. A halogen lamp 12 for generating heat is axially installed along a central shaft within the interior of heating roller 9. A thermistor 13 is installed on one side of a frame (not shown) and controls the temperature of the fixing unit. To prevent the fixing unit from overheating due to a malfunction of thermistor 13, a thermostat 14, which may or may not be in contact with heating roller 9, is installed on one side of the frame. Pressure roller 15 is installed at the bottom of heating roller 9, and applies pressure on heating roller 9 via the force of supporting springs. During an electrophotographic printing operation, an electrical current is provided to halogen lamp 12 from a power source, and the temperature of the innermost surface of heating roller 9 is increased by heat radiated from halogen lamp 12. The heat from the innermost surface of heating roller 9 is radiated through heating roller 9, and is emitted from an outermost surface of heating roller 9 to thereby secure the toner onto the recording medium passing between heating roller 9 and pressure roller 15. Once the outermost surface of heating roller 9 reaches a predetermined temperature, thermistor 13 turns off halogen lamp 12. Similarly, when the outermost surface of heating roller 9 is below the predetermined temperature, thermistor 13 maintains halogen lamp 12 in an on state in order to reach the predetermined temperature. If halogen lamp 12 overheats due to a malfunction of thermistor 13, thermostat 14 operates to interrupt the electrical power supplied to halogen lamp 12.

The recording medium typically has a moisture characteristic of about 5%. This moisture is uniformly distributed throughout the entire surface of the recording medium. Once thermal energy is applied to the recording medium, the moisture evaporates and internal stress which is not uniform is generated at the interior of the recording medium, often causing the recording medium to crease. Since the fixing unit of FIG. 2 often produces a large reduction in thermal conduction efficiency, power consumption increases and the warm-up time for the electrophotographic printing process is increased.

In the operation of the fixing unit shown in FIG. 2, it is often difficult to obtain a uniform thermal distribution along the axial direction of heating roller 9. The distribution of light from halogen lamp 12 is limited by a manufacturing process. Consequently, heat is not uniformly radiated to heating roller 9. Furthermore, since both ends of heating roller 9 are open and thermal energy escapes from the interior of heating roller 9 in a non-uniform manner due to a current formation produced from a cooling fan on the interior of the printing device, the temperature distribution along each portion of heating roller 9 measured at the same time is not uniform. Therefore, the temperature variation over time of any particular portion of heating roller 9 is rather large since halogen lamp 12 is repeatedly turned on and off.

Figure 3:
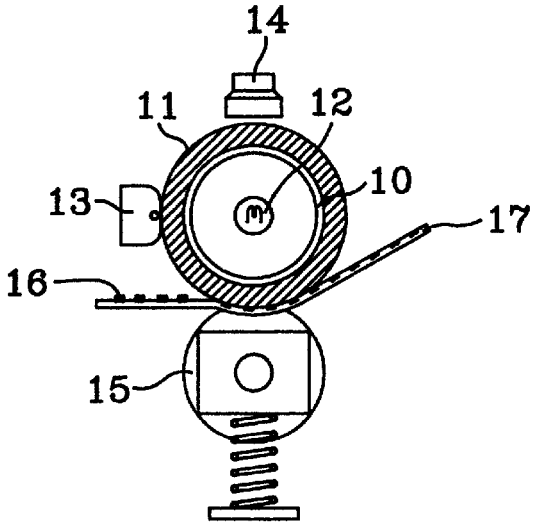
FIG. 3 is a schematic diagram illustrating a fixing unit constructed according to the principles of the present invention.

Referring now to FIG. 3, a schematic diagram of a fixing unit constructed according to the principles of the present invention is shown. In the present invention, a heating roller 11 formed with an aluminum pipe is hollow and has ends which are open. An innermost surface of heating roller 11 is lined with a coating material 10 that readily absorbs infrared radiation in the wavelength region of approximately 3 to 1000 microns. Accordingly, heating roller 11 possesses excellent heat absorption characteristics, and can provide uniform heat distribution along its entire length. According to the principles of physics, when electromagnetic waves contact an object, reflection, transmission and absorption can occur. In the practice of the present invention, electromagnetic waves in the wavelength region of approximately 3 to 1000 microns are absorbed by coating material 10 and are converted into thermal energy. Coating material 10 is preferably composed of a ceramic material, such as an oxide of zirconium, aluminum, titanium, etc., and a nonoxide of carbonic titanium, tungsten, carbide, etc. A halogen lamp 12 for generating heat is spaced apart from the innermost surface of heating roller 11, and is axially installed along a central shaft within the interior of heating roller 11. A thermistor 13 is installed on one side of a frame (not shown) and controls the temperature of the fixing unit. To prevent the fixing unit from overheating due to a malfunction of thermistor 13, a thermostat 14, which may or may not be in contact with heating roller 11, is installed on one side of the frame. Pressure roller 15 is installed at the bottom of heating roller 11, and applies pressure on heating roller 11 via the force of supporting springs. During an electrophotographic printing operation, an electrical current is provided to halogen lamp 12 from a power source, and the temperature of the innermost surface of heating roller 11 is increased by heat radiated from halogen lamp 12. The heat from the innermost surface of heating roller 11 is radiated through heating roller 11, and is emitted from an outermost surface of heating roller 11 to thereby secure toner 16 onto a recording medium 17, such as paper, passing between heating roller 11 and pressure roller 15. Once the outermost surface of heating roller 11 reaches a predetermined temperature, thermistor 13 turns off halogen lamp 12. Similarly, when the outermost surface of heating roller 11 is below the predetermined temperature, thermistor 13 maintains halogen lamp 12 in an on state in order to reach the predetermined temperature. If halogen lamp 12 overheats due to a malfunction of thermistor 13, thermostat 14 operates to interrupt the electrical power supplied to halogen lamp 12.

As described above, the innermost surface of heating roller 11 is lined with coating material 10 that readily absorbs infrared radiation in the wavelength region of approximately 3 to 1000 microns. Therefore, temperature variations of less than 2° C. can be obtained, and the warming-up time is reduced. Moreover, the power consumption is reduced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An apparatus of a fixing unit in an electrophotographic processor, said apparatus comprising:

a hollow cylindrical heating roller having an outer circumferential surface for supporting a printable medium and fixing a toner image onto said printable medium when an outer surface temperature is elevated to a fixing temperature during a fixing operation; and said heating roller having a substantially cylindrical inner surface that is lined with an infrared radiation absorbing material to absorb infrared radiation of a wavelength in the range of 3 to 1000 micrometers for an uniform distribution of heat along an axial direction so as to elevate the outer surface temperature to said fixing temperature for fixing said toner image onto said printable medium during said fixing operation, said infrared radiation absorbing material comprising a ceramic material made from a compound selected from the group consisting of:

an oxide of zirconium,
an oxide of aluminum,
an oxide of titanium,
a nonoxide of carbonic titanium,
a nonoxide of tungsten, and
a nonoxide of carbide.

2. The apparatus of claim 1, further comprising a halogen lamp axially installed along a central shaft within said heating roller for irradiating infrared radiation of said wavelength in the range of 3 to 1000 micrometers to be absorbed by said infrared radiation absorbing material.

3. The apparatus of claim 1, further comprising a pressure roller for engaging and applying pressure upon said printable medium as said printable medium passes between said heating roller and said pressure roller.

4. The apparatus of claim 3, further comprising a halogen lamp axially installed along a central shaft within said heating roller for irradiating said infrared radiation of a wavelength in the range of 3 to 1000 micrometers to be absorbed by said infrared radiation absorbing material.

5. A fixing unit in an electrophotographic printing device, said fixing unit comprising:

a heating roller having an outer circumferential surface for fixing a toner image onto a printable medium when an outer surface temperature is elevated to a fixing temperature during a fixing operation, and a substantially cylindrical inner surface coated with an infrared radiation absorbing material to absorb infrared radiation for an uniform heat distribution along an axial direction so as to elevate the outer surface temperature to said fixing temperature for fixing said toner image onto said printable medium during said fixing operation, said infrared radiation absorbing material consisting essentially of a ceramic material made from a compound selected from the group consisting of:

an oxide of zirconium,
an oxide of aluminum,
an oxide of titanium,
a nonoxide of carbonic titanium,
a nonoxide of tungsten, and
a nonoxide of carbide;

infrared radiation generating means, axially installed along a central shaft within said heating roller and spaced apart from said substantially cylindrical inner surface of said heating roller, for irradiating said infrared radiation;

heat control means for controlling intensity of said infrared radiation; and a pressure roller engaging and applying pressure upon said printable medium as said printable medium passes between said heating roller and said pressure roller so as to imprint said toner image onto said printable medium.

6. The fixing unit of claim 5, wherein said heat generating means comprises a halogen lamp for irradiating said infrared radiation of a wavelength in the range of 3 to 1000 micrometers.

7. The fixing unit of claim 5, wherein said heat control means comprises a thermostat and a thermistor.

8. A fixing unit in an electrophotographic printing device, said fixing unit comprising:

a heating roller having an outer circumferential surface for fixing a toner image onto a printable medium when an outer surface temperature is elevated to a fixing temperature during a fixing operation, and a substantially cylindrical inner surface coated with an infrared radiation absorbing material to absorb infrared radiation of a wavelength in the range of 3 to 1000 micrometers, said infrared radiation absorbing material consisting essentially of a ceramic material made from a compound selected from the group consisting of:

an oxide of zirconium,
an oxide of aluminum,
an oxide of titanium,
a nonoxide of carbonic titanium,
a nonoxide of tungsten, and
a nonoxide of carbide;

infrared radiation generating means, axially installed along a central shaft within said heating roller and spaced apart from said substantially cylindrical inner surface of said heating roller, for irradiating said infrared radiation of said wavelength in the range of 3 to 1000 micrometers; and a pressure roller engaging and applying pressure upon said printable medium as said printable medium passes between said heating roller and said pressure roller while imprinting said toner image onto said printable medium.

9. The fixing unit of claim 8, wherein said infrared radiation generating means comprises a halogen lamp irradiating said infrared radiation of a wavelength in the range of 3 to 1000 micrometers.

* * * * *